US005986519A

United States Patent [19]

Kellett et al.

[11] Patent Number: 5,986,519

[45] Date of Patent: Nov. 16, 1999

[54] COAXIAL CABLE TRANSITION ARRANGEMENT

[76] Inventors: Colin John Kellett, 73 Mary Avenue, Wheelers Hill, Victoria 3150, Australia; Adrian Smith, 95 Dolphin Crescent, Paignton, Devon, TQ3 1JZ, United Kingdom

[21] Appl. No.: 08/930,888

[22] PCT Filed: Apr. 3, 1996

[86] PCT No.: PCT/GB96/00816

§ 371 Date: Apr. 27, 1998

§ 102(e) Date: Apr. 27, 1998

[87] PCT Pub. No.: WO96/31916

PCT Pub. Date: Oct. 10, 1996

[30] Foreign Application Priority Data

Apr. 3, 1995 [GB] United Kingdom ..... 9506878

[51] Int. Cl.[6] ..... H01P 5/08

[52] U.S. Cl. ..... 333/120; 333/33; 333/260

[58] Field of Search ..... 333/24 C, 33, 333/246, 260, 120; 439/63, 581, 582

[56] References Cited

U.S. PATENT DOCUMENTS 5,073,761 12/1991 Waterman et al. ..... 333/24 C 5,309,122 5/1994 Cox et al. ..... 333/24 C X 5,394,119 2/1995 Pleva et al. ..... 333/260 X 5,757,246 5/1998 Johnson ..... 333/260 X

*Primary Examiner*—Paul Gensler

*Attorney, Agent, or Firm*—Lee, Mann, Smith, McWilliams, Sweeney & Ohlson

[57] ABSTRACT

An arrangement for transferring high frequency microwave signals between a cable and a microstrip printed circuit on a dielectric substrate is disclosed wherein a first microstrip track on a first substrate reactively couples with a second microstrip track on a second substrate, which second substrate is connected to an inner conductor of a coaxial cable and a ground plane associated with the first microstrip track is connected to the ground shielding of the coaxial cable. Since the microwave signals are reactively coupled by means of printed circuit tracks on a first dielectric substrate to printed circuit tracks on a second dielectric substrate, a non-contacting RF connection is established. This avoids the potential formation of intermodulation products which occur in metal—metal (galvanic) junctions. A further, advantage arises in that a d.c. block is automatically incorporated within the arrangement, reducing the need for separate coupled lines, capacitors and the like. A method of transferring high frequency microwave signals between a cable and a printed circuit on a dielectric substrate is also disclosed.

16 Claims, 5 Drawing Sheets

COAXIAL CABLE TRANSITION ARRANGEMENT

RELATED APPLICATION

This application is related by disclosure to U.S. application, Ser. No. 08/832,408, also assigned to Nortel Networks Corporation.

BACKGROUND OF THE INVENTION

This invention relates to a coaxial cable transition to a planar substrate arrangement, such as a coaxial cable to microstrip arrangement.

Coaxial cable is widely employed in system configuration, where microwave and radio signals are processed. A typical use of a coaxial to planar substrate transition is in a mobile communications network base station where receive and transmit electronics are connected to a triplate or layered antenna by way of a coaxial cable. One form of triplate antenna comprises a microstrip feed network printed on a dielectric film or substrate which provides the feed probes or patches which extend into or are arranged within radiating apertures defined through the outermost groundplane of the triplate antenna. In such an arrangement, the central conductor of a coaxial cable is soldered directly to the microstrip circuit of the antenna. The axis of the central conductor can either be in-line or orthogonal with respect to the substrate and the earthed sheath is connected to the groundplanes of the antenna. Alternatively, the microstrip array may be formed upon a printed circuit board manufactured from a substance such as PTFE. U.S. Pat. No. 4,918,458 (Ford Aerospace) describes such an antenna arrangement which is fed by way of a coaxial supply cable. GB-A-2007919 (Raytheon) also provides an antenna arrangement which is fed by way of a coaxial supply cable.

These types of configuration, while easy to manufacture can suffer from the generation of passive intermodulation products. Power handling capabilities can be limited since high losses will result from the isolating distances necessary from the coaxial transition section to any power dividers such as Wilkinson couplers. Further problems arise in the use of the dielectrics having high temperature capabilities necessary in order to allow solder connections to be made. Coupled lines can be present in order to provide a d.c. block in cases such as active antennas.

In the design of mechanical connections with microwave conductors, extreme care needs to be exercised for critical applications requiring high linearity, for example, cellular radiocommunications and satellite communications. In the case where components are welded or soldered, attention needs to be paid to the electrical conductor's surface; irregularities and imperfect metal to metal contacts lead to electrical non-linearities. This introduces passive intermodulation, in which deleterious, spurious signals are generated and, generally, these effects vary with frequency, contact pressure, age and other factors.

An object of the invention is to provide an improved coaxial cable to microstripline connection with high mean or peak power handling and very low passive intermodulation product generation.

SUMMARY OF THE INVENTION

In accordance with one aspect of the invention, there is provided an arrangement for transferring high frequency microwave signals between a cable and a microstrip printed circuit on a dielectric substrate, the arrangement comprising:

a coaxial cable, a dielectric substrate carrying a first microstrip printed circuit and an intermediate dielectric substrate carrying a second printed circuit; wherein an inner conductor of the coaxial cable is connected to the second printed circuit of the intermediate dielectric substrate and the outer conductor of the coaxial cable is connected to a ground plane associated with said dielectric substrate; and wherein the printed circuit on the intermediate dielectric is operable to reactively couple all the signals from the coaxial cable to the first printed circuit on said dielectric substrate through the printed circuit of the intermediate dielectric substrate.

The intermediate dielectric substrate can carry a metallized surface acting as a ground plane and to which the ground of the coaxial cable is connected, which ground plane can reactively couple with said ground plane associated with said dielectric substrate.

The inner conductor of the coaxial cable port can be connected to a first node of a five port rat-race-coupler with each of the two nodes adjacent the first node feeding in a balanced fashion an output line which is operable to couple with a printed circuit on said dielectric. The other two nodes of the rat-race-coupler can be connected to ground by terminating resistors.

The other two output nodes of the rat-race-coupler can be connected to the two output arms of a Wilkinson coupler whereby a single transmission line output from the coaxial cable is established. Alternatively, the other two output nodes of the rat-race-coupler can be each connected to a Wilkinson coupler whereby four transmission line outputs from the coaxial cable are established.

The dielectric substrate of the intermediate board can be manufactured from PTFE; said dielectric substrate can be a polyester film. The printed circuit can be arranged in the form of microstrip.

In accordance with a still further aspect of the invention, there is provided a method of transferring high frequency microwave signals between a cable and a printed circuit on a dielectric substrate, in an arrangement comprising: a coaxial cable, a dielectric substrate carrying a first printed circuit and an intermediate dielectric substrate carrying a printed circuit; the method comprising the steps of:

transferring said signals through an inner conductor of the coaxial cable to the printed circuit of the intermediate dielectric substrate, the outer conductor of the coaxial cable being connected to a ground plane associated with said dielectric substrate; and reactively coupling all signals between the coaxial cable and the first printed circuit on said dielectric substrate through the printed circuit of the intermediate dielectric substrate.

In accordance with a further aspect of the invention, there is provided a coaxial to planar substrate coupling arrangement wherein a first microstrip track on a first substrate reactively couples with a second microstrip track on a second substrate, which second substrate is connected to an inner conductor of a coaxial cable and a ground plane associated with the first microstrip track is connected to the ground shielding of the coaxial cable.

The microwave signals are reactively coupled by means of printed circuit tracks on a first dielectric substrate to printed circuit tracks on said dielectric substrate, whereby a non-contacting RF connection is established. This avoids the potential formation of intermodulation products which occur in metal—metal (galvanic) junctions.

Further, a d.c. block is automatically incorporated within the arrangement, reducing the need for separate coupled lines, capacitors and the like. D.C./low frequency blocks are useful—and indeed necessary—for isolating wanted signal components from other signals carrying, for example, unwanted d.c or lower frequency bias, digital or other signals. The incorporation of a reactively coupled groundplane has the advantage that it can facilitate the avoidance of inconsistencies such as multiple ground returns (ground loops).

By having the inner conductor of the coaxial cable connected to a microstrip circuit separate from the first microstrip track, the dielectric substrate supporting the first microstrip track/feed network need not be manufactured from a high temperature dielectric. That is to say the dielectric can be a thin film, for example 0.075 mm thick, with a microstrip circuit printed thereon. This allows the use of a cheap dielectric such as a low temperature polyester film.

Preferably the microstrip is arranged in a triplate configuration to reduce losses, but microstrip transmission lines without a second ground plane, as in the case of triplate, may be used. The microstrip lines from the solder connection on the second dielectric board, the transition board, may separate into two in-phase, oppositely directed microstrip lines or may form a node of a balanced five node rat-race circuit element with power being coupled from the two nodes adjacent the input node. It has been found that a balanced five node device provides a convenient coupling arrangement, but other types of rat-race or other combiner/splitter are possible. Preferably microstrip elements are arranged around the input node to suppress propagation of undesired modes having significant field components parallel with the ground planes.

BRIEF DESCRIPTION OF THE DRAWINGS

Embodiments of the invention will now be described with reference to the accompanying drawings, in which.

DESCRIPTION OF THE PREFERRED EMBODIMENTS

Figure 1:
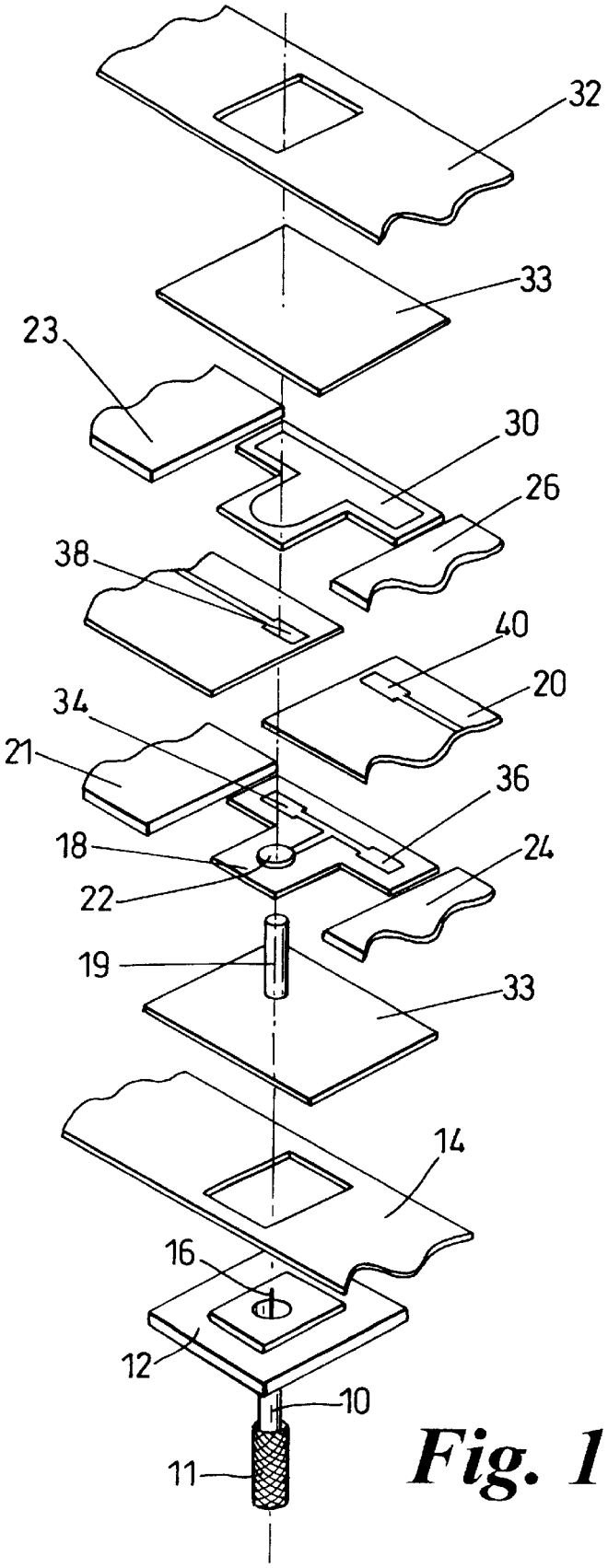
FIG. 1 shows a first embodiment of the invention.

Referring now to FIG. 1, there is shown a first arrangement in accordance with the invention wherein a coaxial cable 10 having an outer conductor 11 and having a ground connection transition body 12 is attached to a first ground plane 14 of the triplate structure. An example of a transition body is shown in detail in FIG. 4. The inner conductor 16 of the coaxial cable is connected to a transitional dielectric substrate 18 having a microstrip network printed thereon, arranged in a 'T' layout on the surface opposite the first ground plane 14, which does not detail mounting features for transition body 12. A thin dielectric 20 supports a microstrip network for the triplate structure. The dielectric 20 has a cut-out portion corresponding to the area of the solder joint 22 effected on the transition portion 18 from the inner conductor of the coaxial cable. The microstrip network is printed on the side of the dielectric facing away from the first groundplane 14. Dielectric layers 21,23 such as foam layers 24,26 are placed either side of dielectric 20, around the transition board 18 and around the optional secondary transition board 30. Optional transition board 30 serves to prevent the solder from contacting with a second ground plane 32. The microstrip patch elements 34, 36 of the transition board 18 capacitively couple with microstrip elements 38, 40 of the microstrip network on dielectric 20.

Figure 2:
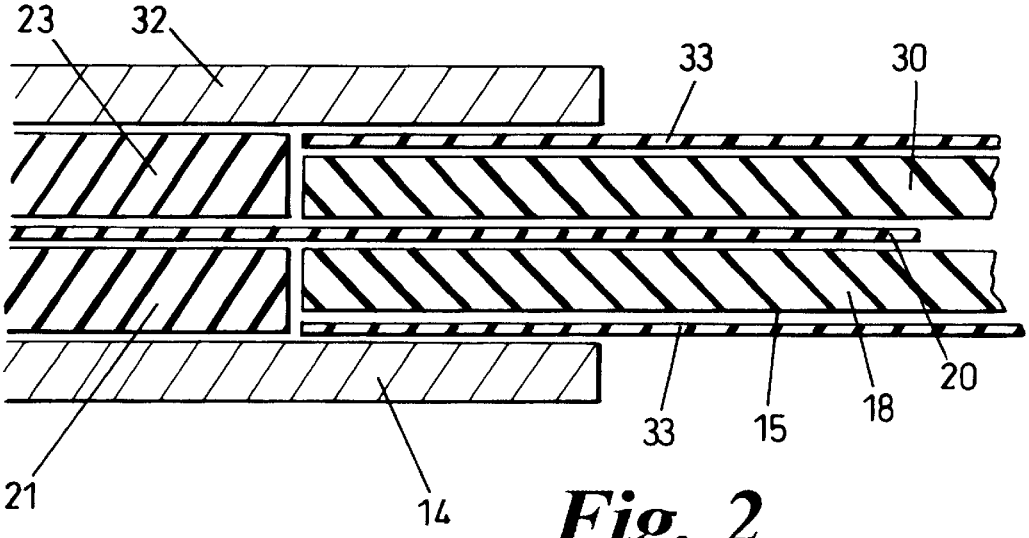
FIG. 2 details the first embodiment in partial section.

FIG. 2 details the sections of the embodiment shown in FIG. 1, but does not detail coaxial cable 10 and transition body 12. The triplate structure is defined by two metal plates 14, 32 made from, for example, aluminium alloy. A dielectric film 20 supports a microstrip network, which film is supported between two layers of high density foam 21, 23, 24, 26 (FIG. 1) whereby optimum distances between the film 20 and the metallic plates of the triplate structure are maintained. The intermediate boards of the transition arrangement 18, 30 lie either side of the dielectric film 20, while a plastic sheet such as polyester 33 isolates the ground plane 15 on the underside of the intermediate board 18 from the ground plane 14 of the triplate structure and the grounding effect is thus reactively coupled.

Figure 3:
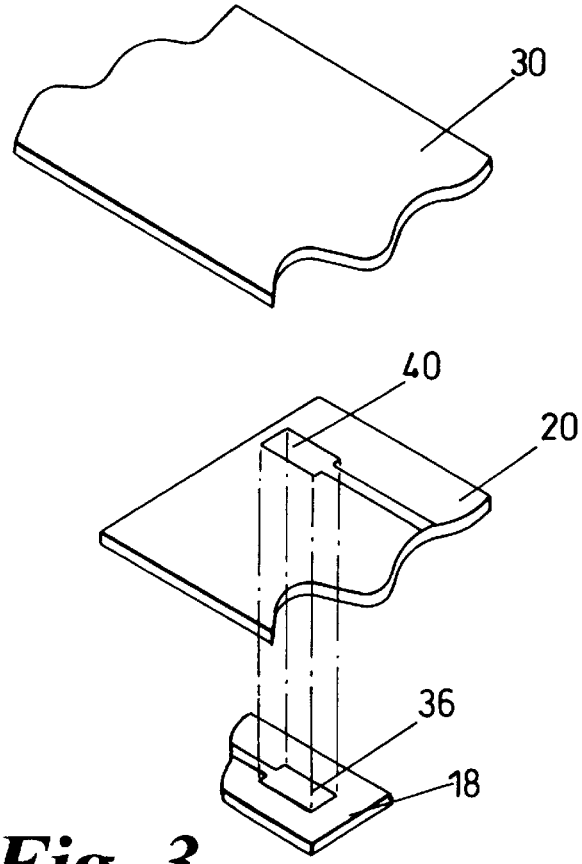
FIG. 3 shows the relative positions of coupled portions.

FIG. 3 details, in a perspective spaced-apart relationship, the intermediate boards 18, 30 of the transition arrangement. The dielectric film 20 having a metallized track with a coupling patch 40 on a first side is positioned with its second side against the intermediate board 18. Coupling patch 40 is arranged opposite a similarly shaped metallized patch 36 of the microstrip network on the intermediate board 18 to ensure optimum coupling—although the coupling region may in fact be no more than a portion of metallized line. Conveniently, the microstrip line from the coaxial cable divides into two probes, which probes separately couple with corresponding patches on the polyester film since the power can be easily split between the two arms without excessive power loss due to reflections. Alternatively, the two arms from the coaxial feed point can feed a Wilkinson divider, whereby four coupling patches may couple with corresponding patches on the polyester film.

Figure 4:
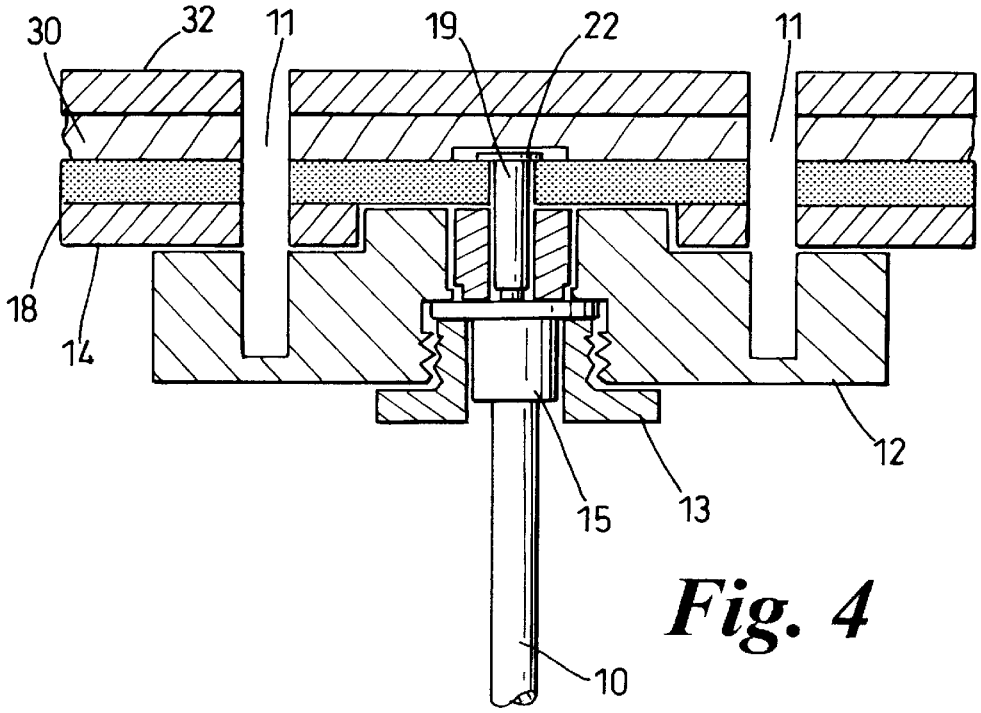
FIG. 4 shows a first coaxial termination element.

One form of coaxial termination is shown in FIG. 4, and depicts the relative positions, albeit not to scale, of coupled portions of a further embodiment, in the region where the intermediate board portions overlap. In this example, a connector-socket 12 is positioned within a recess of groundplane 14. Drilled and tapped holes 11 are arranged to accept bolts (not shown) which fasten the arrangement to a triplate structure 14,18,30 & 32. Alternatively, the bolts may be self tapping. A female contact 19 is soldered to the board and to the microstrip tracks. This contact has a split sleeve configuration which can engage a central conductor of a coaxial cable in a sliding contact fashion, which can accomodate movement due to thermal expansion and other effects. The central portion of the connector has a recess which is internally threaded at the entrance and an abutment portion, the abutment portion being shaped to abut against a ferrule associated with the end of a coaxial cable upon connection of screw-threaded bolt 13.

Figure 5:
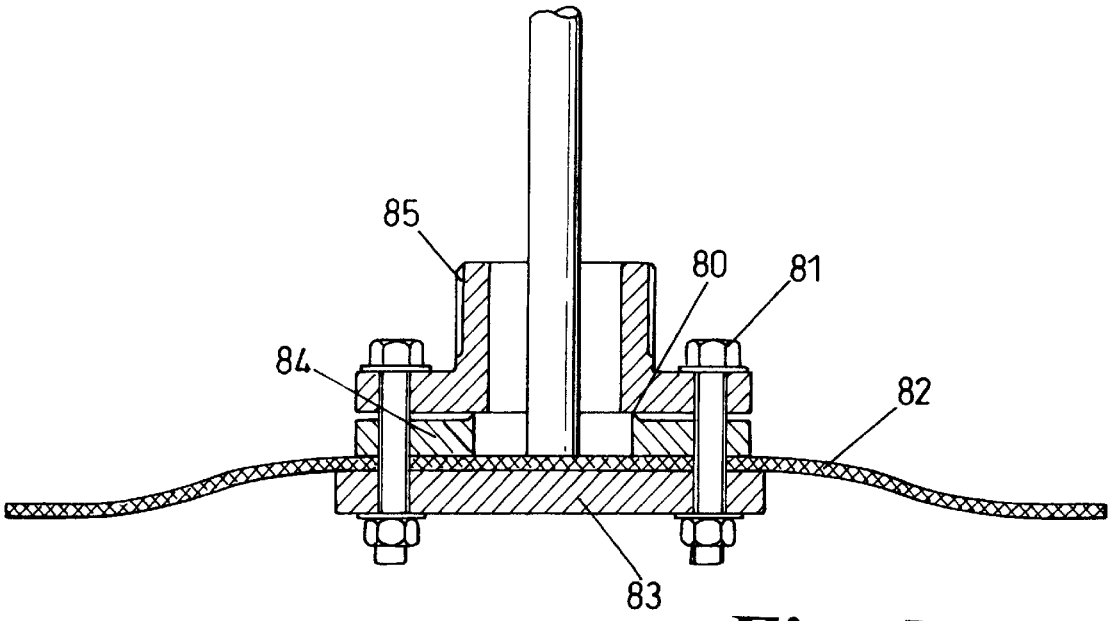
FIG. 5 shows a second coaxial termination element.

FIG. 5 shows a second type of coaxial cable to stripline/microstrip configuration having bolts 81 which attach the connector to the dielectric structure 82 (which can be flexible). Details of the specific connection between the inner conductor of the coaxial cable 86 and the substrate 82 are not shown. The abutment portion 84 has a circumferential line or edge contact arrangement 80, which edge is compressed upon abutment with the other ferrule or abutment portion. The ferrule 85 could possess the circumferential line or edge contact arrangement. The ferrule 85 indicates a coaxial connection, reference numeral 83 indicates part of the connector structure on the other side of the dielectric to the abutment portions 84, 85 and to which the abutment portions 84, 85 are connected by means of bolts 81.

Figure 6:
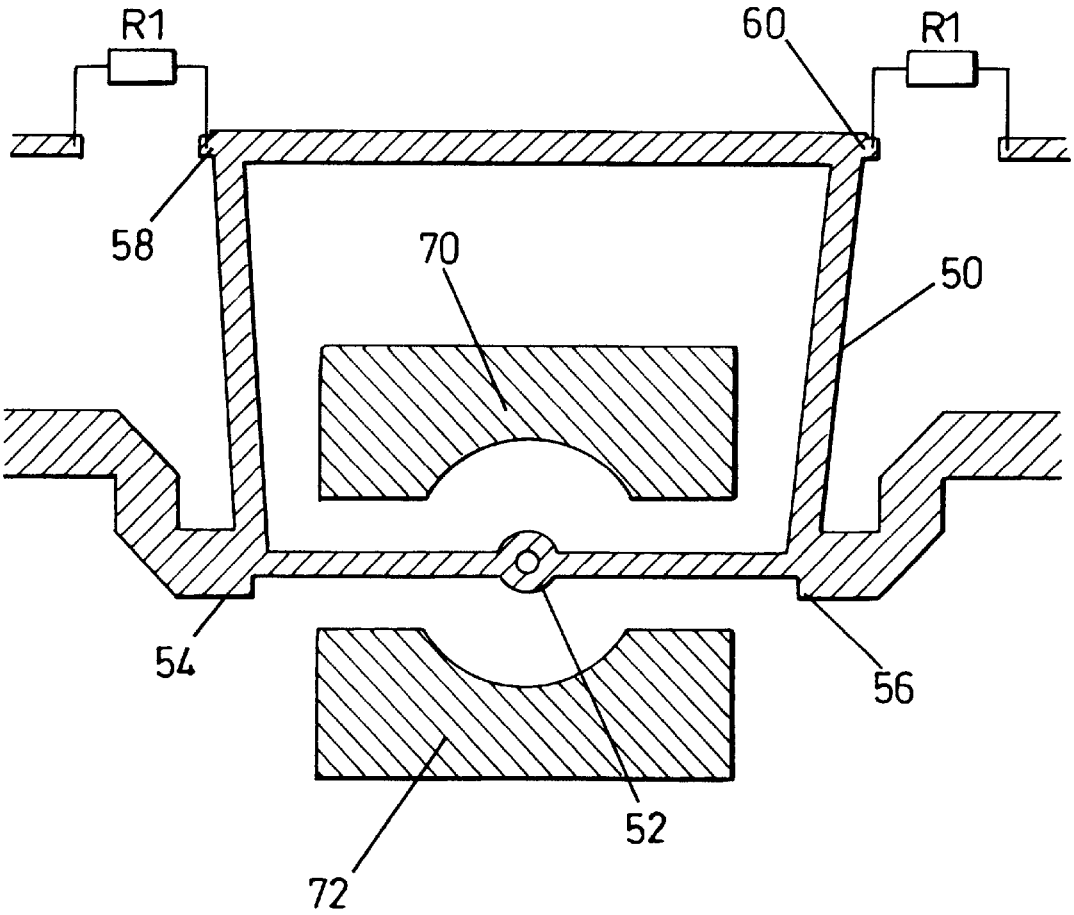
FIG. 6 shows a rat-race-coupling arrangement.

FIG. 6 details a second type of microstrip network for the transition section 18, comprising a balanced five port rat-race circuit element 50, wherein one of the nodes 52 of the rat-race is the coaxial-solder transition. The nodes or ports 54, 56 either side of the input node 52 act as output ports which can feed couplers such as Wilkinson couplers (not shown) which enable power to be divided or combined with respect to the output arms. Thus, using two Wilkinson couplers, four coupled portions can be provided from the arrangement. This is a compact coupling arrangement, which is especially useful in microstrip antenna arrangements. Metallized portions 70, 72 act to confine the microwave propagation along the rat-race rather than between the microstrip lines and the ground plane in a parasitic and lossy fashion. Terminating resistors R1, R2 are preferably placed at the unused ports of the rat-race, as is well known. A grounded area can be provided on the same side as the microstrip pattern to aid parasitic mode suppression. Such a grounded area can be readily fabricated by appropriate metallization and extending vias from the earth plane on the other side of the intermediate board, and/or by metallizing around the edge of the substrate.

Figure 7:
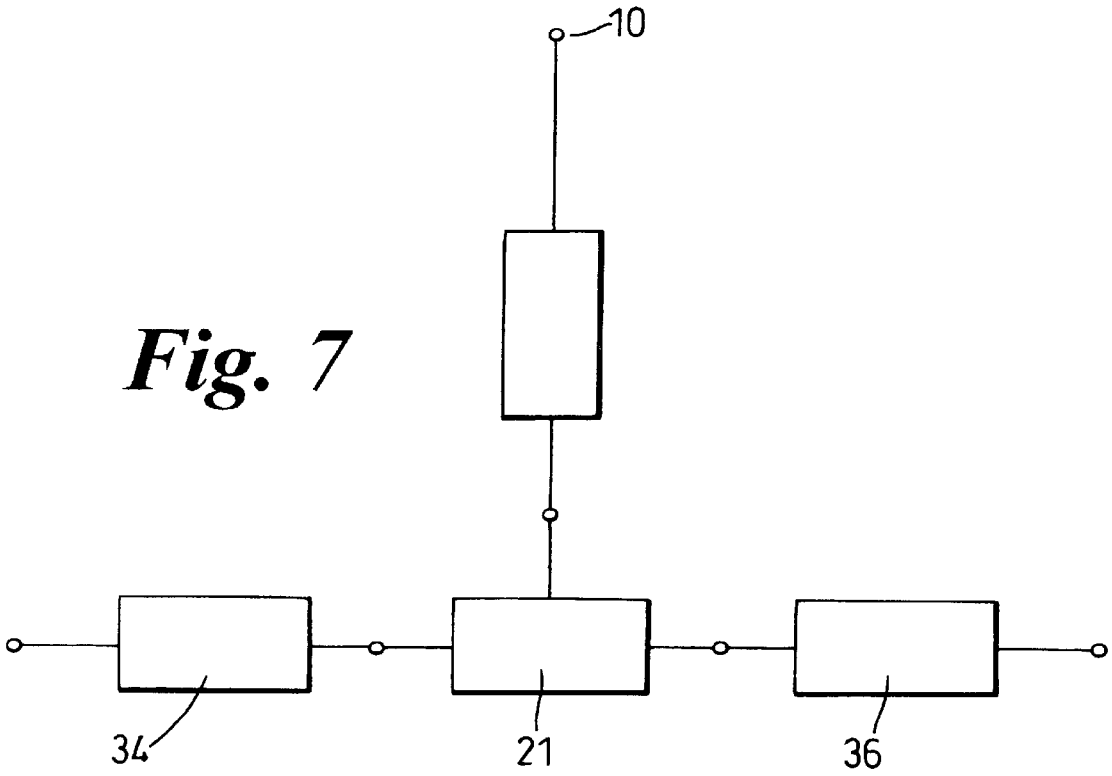
FIGS. 7 and 8 demonstrate the equivalence of the embodiments.
Figure 8:
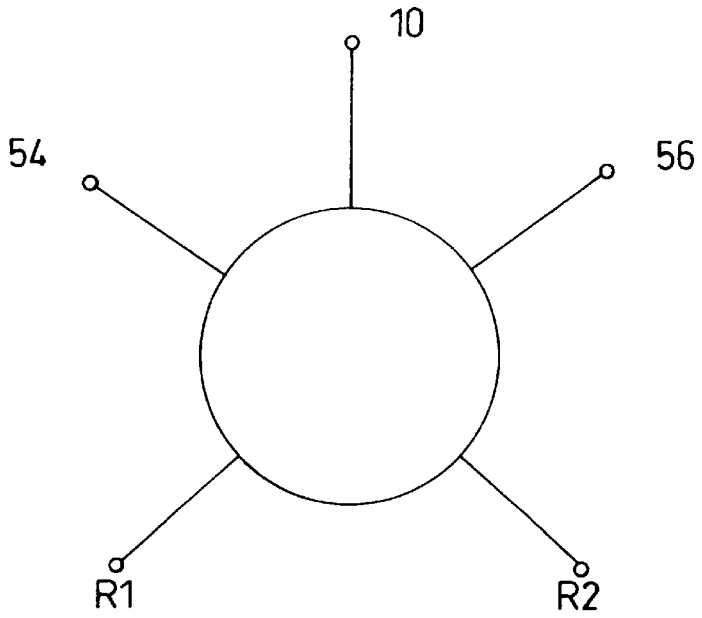

FIGS. 7 and 8 show the equivalence of the two forms of coupling arrangements as shown in FIGS. 1 and 6. The rat-race is internally matched to reduce losses and by having an in-phase splitter, the ports are in-phase. The metallized portion 70 is preferably connected to the rat-race by a resistive element to avoid over-moding. Note also that instead of feeding two Wilkinson couplers, the two ports from the rat-race could feed the two input arms of a Wilkinson coupler to provide a single output.

By providing a reactively coupled connection, direct contact between dissimilar metals is reduced, thus reducing a source of inter-modulation noise and non-linearities. Preferably, through the use of silver plated components, fluxless solder and the use of solder reflow techniques where appropriate, noise generation is further reduced.

In order to keep manufacturing costs to a minimum the transition body can be a simple turned part and incorporate a slot in the mating face. This slot can allow self tapping screws to be used to fasten the transition body to the transition board assembly. This feature has two advantages: firstly, alignment is only necessary in one coordinate direction between the fixing holes in the transition board assembly and the transition body, and secondly, the transition body is cheap to manufacture as it avoids the need for costly tapped holes for fixing screws.

The female contact soldered to the transition board allows the center conductor of the semi-rigid cable to slide within it thus avoiding mechanical stress during thermal expansion of the cable and the use of existing well proven connector parts within the transition assures very low intermodulation product generation. The microstrip networks can be formed from copper and the substrate upon which the microstrip networks are supported can be polyester, both of which being commonly used for such purposes.

The transition board is preferably manufactured from PTFE, which when metallized can provide a solderable substrate for the female contact in the transition. PTFE has a relatively high melting point which lends itself readily to soldering. The use of PTFE is preferable to that of a foam/film/foam sandwich for triplate since the PTFE can better accomodate high powers, is of low loss and, further, PTFE exhibits a better thermal conductivity than foam/film/foam. The assembly can thus handle relatively high powers and operate within an acceptable temperature range.

The coaxial cable may be rigid, semi-rigid or flexible. The ground planes shown may be formed from aluminium alloy, which offers a good strength to weight ratio and is highly corrosion resistant.

We claim:

1. An arrangement for transferring high frequency microwave signals between a cable and a printed circuit on a dielectric substrate, the arrangement comprising: a coaxial cable (10) having an inner conductor (16) and an outer conductor (11), a first around plane (14), a first dielectric substrate (20) having a first printed circuit, an intermediate dielectric substrate (18) having a second printed circuit and a ground plane (15);

wherein the second printed circuit comprises a five port rat-race coupler and a Wilkinson coupler having two coupling arms and an output;

wherein the inner conductor of the coaxial cable is connected to a first port of said five port rat-race-coupler, wherein third and fourth ports of said rat-race-coupler are connected to ground by terminating resistors (R1, R2); and wherein the second and fifth ports (54, 56) provide output ports which are connected to the two coupling arms of the Wilkinson coupler which is operable to provide a coupled output port;

wherein said outer conductor of the coaxial cable (11) is connected to said around plane (14) which is arranged to reactively couple with said ground plane associated with said dielectric substrate (20);

the arrangement being operable to provide a single output on a dielectric substrate from a coaxial cable input.

2. An arrangement according to claim 1, wherein the dielectric substrate of the intermediate board is manufactured from PTFE.

3. An arrangement according to claim 1, wherein said first dielectric substrate is a polyester film.

4. An arrangement according to claim 1, wherein the printed circuit is arranged in the form of microstrip.

5. An arrangement according to claim 1, wherein said ground plane (15) is printed on the intermediate dielectric.

6. An arrangement for transferring high frequency microwave signals between a cable and a printed circuit on a dielectric substrate, the arrangement comprising: a coaxial cable (10) having an inner conductor (16) and an outer conductor (11), a first ground plane (14), a first dielectric substrate (20) having a first printed circuit, an intermediate dielectric substrate (18) having a second printed circuit and a ground plane (15);

wherein the second printed circuit comprises a five port rat-race coupler and two Wilkinson dividers, each Wilkinson divider, having an input and two outputs;

wherein the inner conductor of the coaxial cable is connected to a first port of said five port rat-race-coupler, wherein the third and fourth ports of said rat-race-coupler are connected to ground by terminating resistors (R1, R2); and wherein the second and fifth ports (54, 56) provide output ports which are connected to the input of the Wilkinson divider which is operable to provide two output ports wherein the outer conductor of the coaxial cable (11) is connected to said ground plane (14) which is arranged to reactively couple with said ground plane associated with said dielectric substrate (20);

the arrangement being operable to provide four outputs to a dielectric substrate from a coaxial cable input.

7. A method of transferring high frequency microwave signals between a cable and a printed circuit on a dielectric substrate, in an arrangement comprising: a coaxial cable (10) having an inner conductor (16) and an outer conductor (11), a first ground plane (14), a first dielectric substrate (20) having a first printed circuit, an intermediate dielectric substrate (18) having a second printed circuit and a ground plane (15);

wherein the second printed circuit comprises a five port rat-race coupler, a ground plane (15) and a Wilkinson coupler, having two coupling arms and an output;

wherein the inner conductor of the coaxial cable is connected to a first port of said five port rat-race-coupler, wherein third and fourth ports of said rat-race-coupler are connected to ground by terminating resistors (R1, R2); and wherein second and fifth ports (54, 56) are connected to the two coupling arms of the Wilkinson coupler which provides a coupled output port;

wherein the outer conductor of the coaxial cable (11) is connected to said ground plane (14) which is arranged to reactively couple with said ground plane (15) associated with said dielectric substrate (18);

the method comprising the steps of:

transferring said signals through an inner conductor (16) of the coaxial cable (10) to the first port of the five port rat-race-coupler;

transferring the signals to second and fifth ports (54, 56);

transferring the signals from second and fifth ports (54, 56) to feed, in a balanced fashion, the Wilkinson coupler to provide an output at the output port;

reactively coupling signals from the output of the Wilkinson coupler to said dielectric substrate (20), whereby a single output from the coaxial cable is established on the first dielectric.

8. An arrangement according to claim 7, wherein the dielectric substrate of the intermediate board is manufactured from PTFE.

9. An arrangement according to claim 7, wherein said first dielectric substrate is a polyester film.

10. An arrangement according to claim 7, wherein said ground plane (15) is printed on the intermediate dielectric.

11. A method of transferring high frequency microwave signals between a cable and a printed circuit on a dielectric substrate, in an arrangement comprising: a coaxial cable (10) having an inner conductor (16) and an outer conductor (11), a first ground plane (14), a first dielectric substrate (20) having a first printed circuit, an intermediate dielectric substrate (18) having a second printed circuit and a ground plane (15);

wherein the second printed circuit comprises a five port rat-race coupler and two Wilkinson dividers, each Wilkinson divider, having an input and two outputs;

wherein the inner conductor of the coaxial cable is connected to a first port of said five port rat-race-coupler, wherein third and fourth ports of said rat-race-coupler are connected to ground by terminating resistors (R1, R2); and wherein second and fifth ports (54, 56) provide output ports and are each connected to an input arm of a respective Wilkinson divider to provides four output ports;

wherein the outer conductor of the coaxial cable (11) is connected to said ground plane (14) which is arranged to reactively couple with said ground plane (15) associated with said dielectric substrate (18);

the method comprising the steps of:

transferring said signals through an inner conductor (16) of the coaxial cable (10) to the first node of said five port rat-race-coupler;

transferring the signals to second and fifth ports (54, 56);

transferring the signals from second and fifth ports (54, 56) to feed respective Wilkinson dividers to provide four outputs; reactively coupling signals from the outputs of the Wilkinson dividers to said first dielectric substrate (20), whereby four outputs from the coaxial cable are established on the first dielectric.

12. An arrangement for transferring high frequency microwave signals between a cable and a printed circuit on a dielectric substrate, the arrangement comprising: a coaxial cable (10) having an inner conductor (16) and an outer conductor (11), a first around plane (14), a first dielectric substrate (20) having a first printed circuit, an intermediate dielectric substrate (18) having a second printed circuit and a ground plane (15);

wherein the second printed circuit comprises a five port rat-race coupler;

wherein the inner conductor of the coaxial cable is connected to a first port of said five port rat-race-coupler which conductor is oriented substantially normally to the dielectric substrate;

wherein the third and fourth ports of said rat-race-coupler are connected to ground by terminating resistors (R1, R2); wherein ground patches are provided either side of the first port whereby to confine modes of propagation to enable the transfer of signals from an input coaxial connector at the first port to the second and fifth ports;

wherein the outer conductor of the coaxial cable (11) is connected to said ground plane (14) which is arranged to reactively couple with said ground plane (15) associated with said dielectric substrate (18);

the arrangement being operable to provide two outputs on said first dielectric substrate (20) coupled via the second and fifth ports of said rat-race coupler from said coaxial cable (10).

13. An arrangement according to claim 12, wherein the dielectric substrate of the intermediate board is manufactured from PTFE.

14. An arrangement according to claim 12, wherein said first dielectric substrate is a polyester film.

15. An arrangement according to claim 12, wherein said ground plane (15) is printed on the intermediate dielectric.

16. A method of transferring high frequency microwave signals between a cable and a printed circuit on a dielectric substrate, in an arrangement comprising: a coaxial cable (10) having an inner conductor (16) and an outer conductor (11), a first around plane (14), a first dielectric substrate (20) having a first printed circuit, an intermediate dielectric substrate (18) having a second printed circuit and a ground plane (15);

wherein the second printed circuit comprises a five port rat-race coupler;

wherein the inner conductor of the coaxial cable is connected to a first port of said five port rat-race-coupler which conductor is oriented substantially normally to the dielectric substrate;

wherein the third and fourth ports of said rat-race-coupler are connected to ground by terminating resistors (R1, R2);

wherein ground patches are provided either side of the first port whereby to confine modes of propagation to enable the transfer of signals from an input coaxial connector at the first port to the second and fifth ports;

wherein the outer conductor of the coaxial cable (11) is connected to said ground plane (14) which is arranged to reactively couple with said ground plane (15) associated with said dielectric substrate (18);

the method comprising the steps of:

transferring said signals through an inner conductor (16) of the coaxial cable (10) to the first port of said five port rat-race-coupler;

transferring the signals to second and fifth ports (54, 56);

transferring the signals from second and fifth ports (54, 56) to provide two outputs;

reactively coupling signals from the two outputs from said rat-race coupler to said first dielectric substrate (20), whereby to provide two outputs from the coaxial cable on the first dielectric from the coaxial cable input.

* * * * *